US007482543B2

(12) United States Patent
Hsu

(10) Patent No.: US 7,482,543 B2
(45) Date of Patent: Jan. 27, 2009

(54) SIGNAL GENERATING MODULE

(75) Inventor: Ti-Ming Hsu, Taipei (TW)

(73) Assignee: Compal Electronics , Inc, Taipei (TW)

( * ) Notice: Subject to any disclaimer, the term of this patent is extended or adjusted under 35 U.S.C. 154(b) by 114 days.

(21) Appl. No.: 11/735,508

(22) Filed: Apr. 16, 2007

(65) Prior Publication Data

US 2008/0078663 A1 Apr. 3, 2008

(30) Foreign Application Priority Data

Oct. 3, 2006 (TW) ..... 95136701 A

(51) Int. Cl.
*H01H 19/58* (2006.01)

(52) U.S. Cl. ..... 200/14; 200/513

(58) Field of Classification Search ..... 200/14, 200/310–314, 341–345, 512–520; 361/809, 361/814

See application file for complete search history.

(56) References Cited

U.S. PATENT DOCUMENTS 5,489,754 A * 2/1996 Dirmeyer et al. ..... 200/302.1
5,505,115 A * 4/1996 Vandervoort ..... 84/423 R
5,513,078 A * 4/1996 Komrska et al. ..... 361/816
6,525,279 B2 * 2/2003 Sato ..... 200/6 A
6,661,354 B2 * 12/2003 Johnson et al. ..... 341/16
6,809,660 B2 * 10/2004 Bestle ..... 341/20
7,129,433 B2 * 10/2006 Tokusashi ..... 200/344

FOREIGN PATENT DOCUMENTS

TW 454891 9/2001

* cited by examiner

*Primary Examiner*—Michael A Friedhofer
*Assistant Examiner*—Lisa N Klaus
(74) *Attorney, Agent, or Firm*—Jianq Chyun IP Office

(57) ABSTRACT

A signal generating module is provided. The signal generating module includes a processor, an arcuate elastomer, a first fixed contact, a second fixed contact, a first pin, and a second pin. The processor is disposed on the circuit board of an electronic apparatus. The arcuate elastomer is disposed in the electronic apparatus, and includes a first movable contact and a second movable contact. The arcuate elastomer has a portion exposed out from a housing of the electronic apparatus. The first fixed contact is fixed to the electronic apparatus corresponding to the first movable contact. The second fixed contact is fixed to the electronic apparatus corresponding to the second movable contact. The first pin is secured to the circuit board, coupled to the processor, and coupled to the first fixed contact. The second pin is secured to the circuit board, coupled to the processor, and coupled to the second fixed contact.

11 Claims, 4 Drawing Sheets

SIGNAL GENERATING MODULE

CROSS-REFERENCE TO RELATED APPLICATION

This application claims the priority benefit of Taiwan application serial no. 95136701, filed Oct. 3, 2006. All disclosure of the Taiwan application is incorporated herein by reference.

BACKGROUND OF THE INVENTION

1. Field of the Invention

The present invention relates to a signal generating module, and more particularly to a signal generating module adapted for adjusting a signal emitting intensity.

2. Description of Related Art

Recently, as notebook computers are more widely used, consumers are paying more attentions to additional audio and video functions thereof, which enables some types of notebook computers to function as general family audio and video apparatuses in addition to their original functions. Therefore, consumers pay attention not only to the size of displays and performance of speakers but also to the convenience of sound volume control of notebook computers.

Typically, a notebook computer controls the sound volume of a speaker with an aid of software, which is inconvenient for users. Therefore, some notebook computers apply variable resistors to control the sound volume. However, the sound volume set by variable resistor does not match with that set by software, which requires adjustment of the variable resistor and software interface in sequence to obtain the maximum sound volume. Additionally, a variable resistor may malfunction due to poor contact after long time operation.

Taiwan patent publication No. 454891 discloses a digital sound volume control knob for a notebook computer including a primary control element and an auxiliary control element. The primary control element includes at least one spring leaf and the auxiliary control element includes a plurality of chips. The relative rotation or displacement between the primary control element and the auxiliary control element allows the spring leaf to contact with different chips to generate different electrical signals so as to control the sound volume.

Since the sound volume control method of the sound volume control knob according to the above patent belongs to digital control, the digital sound volume control knob may synchronize with the sound volume control by software. In other words, while a user rotates the digital sound volume control knob, the sound volume settings by software is also adjusted accordingly, which may facilitate the operation of the sound volume controlling. Therefore, a user may adjust a speaker to the maximum sound volume through the digital sound volume control knob or software interface.

SUMMARY OF THE INVENTION

Accordingly, the present invention is directed to a signal generating module adapted for generating various control signals by applying external force.

The present invention is also directed to a signal generating module adapted for adjusting an emitting intensity of a signal emitting terminal thereof.

The present invention is also directed to a signal generating module adapted for a sound volume adjusting module for adjusting the sound volume of a speaker.

In accordance with the foregoing objects and other objects of the present invention, a signal generating module adapted for an electronic apparatus is provided. The electronic apparatus includes a housing and a circuit board secured in the housing. The signal generating module includes a processor, an arcuate elastomer, a first fixed contact, a second fixed contact, a first pin and a second pin.

The processor is disposed on the circuit board. The arcuate elastomer is disposed in the electronic apparatus, and includes a first movable contact and a second movable contact. The arcuate elastomer has a certain portion exposed out from the housing. The first fixed contact is fixed to the electronic apparatus corresponding to the first movable contact. The second fixed contact is fixed to the electronic apparatus corresponding to the second movable contact. The first pin is secured to the circuit board, coupled to the processor, and coupled to one of the first fixed contact and the first movable contact. The second pin is secured to the circuit board, coupled to the processor, and coupled to one of the second fixed contact and the second movable contact.

When no external force is applied on the arcuate elastomer, the first movable contact stays isolated from the first fixed contact, and the second movable contact stays isolated from the second fixed contact either. However, when an external force is applied on the arcuate elastomer and the arcuate elastomer is deformed, the first movable contact comes in contact with the first fixed contact, and/or the second movable contact comes in contact with the second fixed contact so that the processor generates a control signal by evaluating signals transmitted from the first pin and the second pin.

According to an embodiment of the present invention, the foregoing arcuate elastomer includes an arcuate portion, a fixed portion, a first elastic portion and a second elastic portion. The fixed portion is secured to the circuit board, and the first elastic portion and the second elastic portion are connected between the arcuate portion and the fixed portion.

When the arcuate portion is subjected to an external force in a first direction, the first elastic portion is deformed, and the first movable contact comes in contact with the first fixed contact while the second movable contact stays isolated from the second fixed contact. When the arcuate portion is subjected to an external force in a second direction, the second elastic portion is deformed, and the second movable contact comes in contact with the second fixed contact while the first movable contact stays isolated from the first fixed contact. When the arcuate portion is subjected to an external force in a third direction, both the first and the second elastic portion are deformed, and the first elastic portion comes in contact with the first fixed contact, and the second elastic portion comes in contact with the second fixed contact.

According to an embodiment of the present invention, the foregoing arcuate portion, the fixed portion, the first elastic portion, and the second elastic portion are integrally formed.

According to an embodiment of the present invention, the foregoing signal generating module further includes a third pin which is coupled to a grounded terminal of the processor or the electronic apparatus.

According to an embodiment of the present invention, the foregoing first pin can be coupled to the first fixed contact, the second pin can be coupled to the second fixed contact, and the third pin can be coupled to both of the first movable contact and the second movable contact.

According to an embodiment of the present invention, the foregoing first pin can be coupled to the first movable contact, the second pin can be coupled to the second movable contact, and the third pin can be coupled to both of the first fixed contact and the second fixed contact.

According to an embodiment of the present invention, the foregoing first pin can be coupled to the first fixed contact, the second pin can be coupled to the second movable contact, and the third pin can be coupled to both of the first movable contact and the second fixed contact.

According to an embodiment of the present invention, the foregoing signal generating module further includes a signal emitting terminal coupled to the processor and adapted for adjusting an emitting intensity according to the control signal.

According to an embodiment of the present invention, the foregoing signal emitting terminal includes an amplification circuit and a speaker, wherein the foregoing signal emitting intensity is a sound volume.

Accordingly, the signal generating module according to the present invention employs an arcuate elastomer, which can be deformed by applying an external force so that the first movable contact comes in contact with the first fixed contact, and/or the second movable contact comes in contact with the second fixed contact. In this way, the signal generating module can generate signals in accordance with contact status, and adjust the signal emitting intensity with an aid of digital control circuit or software.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
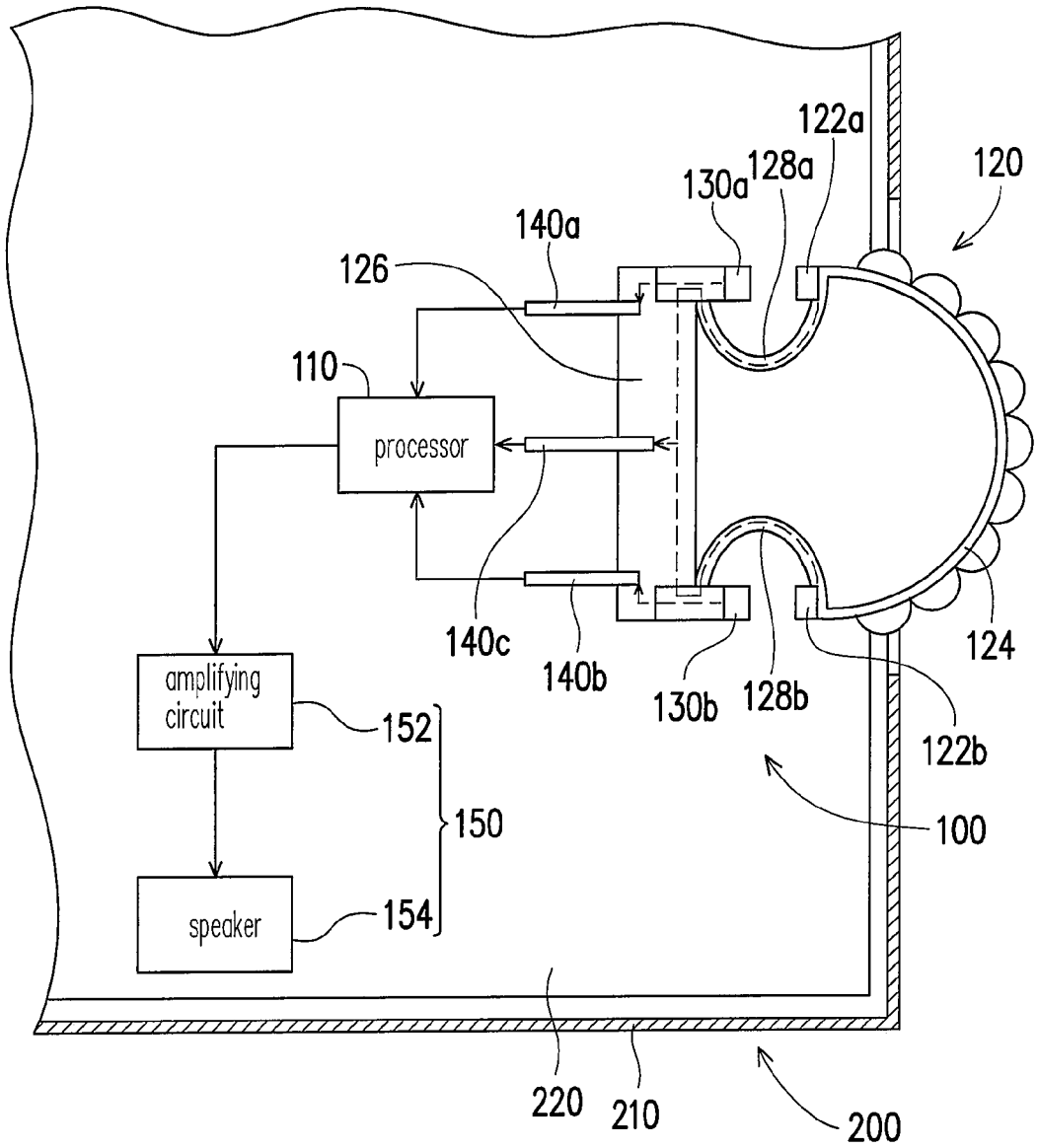
FIG. 1 illustrates a signal generating module employed in an electronic apparatus according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1 illustrates a signal generating module employed in an electronic apparatus according to an embodiment of the present invention. Referring to FIG. 1, the signal generating module 100 is adapted for an electronic apparatus 200, e.g., a notebook computer, or other electronic devices. The electronic apparatus 200 includes a housing 210 and a circuit board 220 secured in the housing 210. The circuit board 220 for example is a mother board, a printed circuit board (PCB), or other boards having circuits distributed thereon.

The signal generating module 100 includes a processor 110, and an arcuate elastomer 120. The processor 110 is disposed on the circuit board 220. The arcuate elastomer 120 is received in the electronic apparatus 200. The elastomer 120 includes a first movable contact 122*a*, and a second movable contact 122*b*, and a certain portion exposed out from the housing 210, allowing a user to apply a force thereon.

The signal generating module 100 further includes a first fixed contact 130*a* and a second fixed contact 130*b*. The first fixed contact 130*a* corresponding to the first movable contact 122*a* is fixed to the electronic apparatus 200. The second fixed contact 130*b* corresponding to the second movable contact 122*b* is fixed to the electronic apparatus 200.

The signal generating module 100 further includes a first pin 140*a* and a second pin 140*b*. The first pin 140*a* is secured on the circuit board 220, coupled to the processor 110, and is coupled to the first fixed contact 130*a*. The second pin 140*b* is secured on the circuit board 220, coupled to the processor 110, and is coupled to the second fixed contact 130*b*.

In the present embodiment, the arcuate elastomer 120 includes an arcuate portion 124, a fixed portion 126, a first elastic portion 128*a* and a second elastic portion 128*b*. The fixed portion 126 is fixed on the circuit board 220. The first elastic portion 128*a* and the second elastic portion 128*b* are connected between the arcuate portion 124 and the fixed portion 126. It is to be noted that the arcuate portion 124, a fixed portion 126, a first elastic portion 128*a* and the second elastic portion 128*b* can be integrally formed.

Figure 2A:
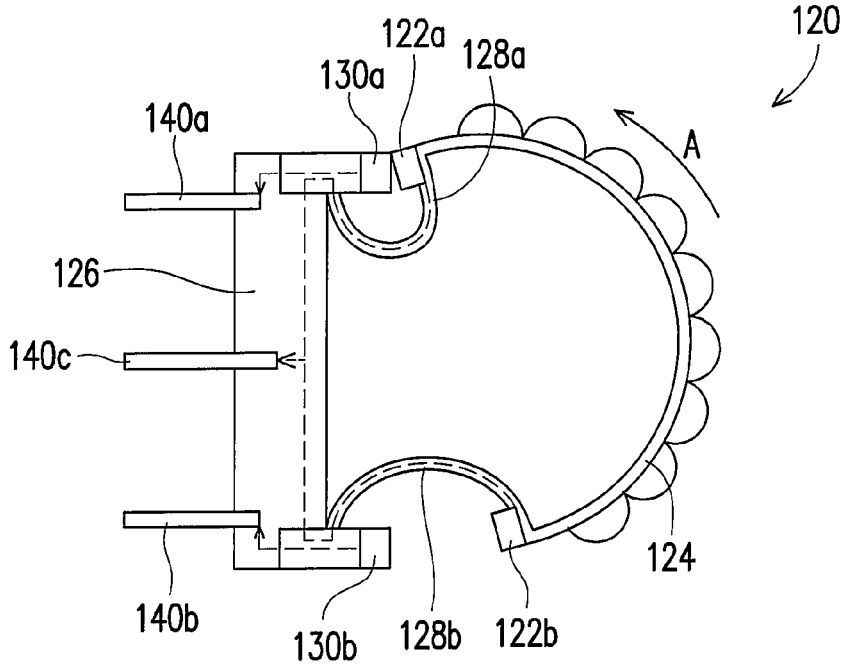
FIGS. 2A to 2C illustrate three operation states respectively of the arcuate elastomer of FIG. 1.
Figure 2B:
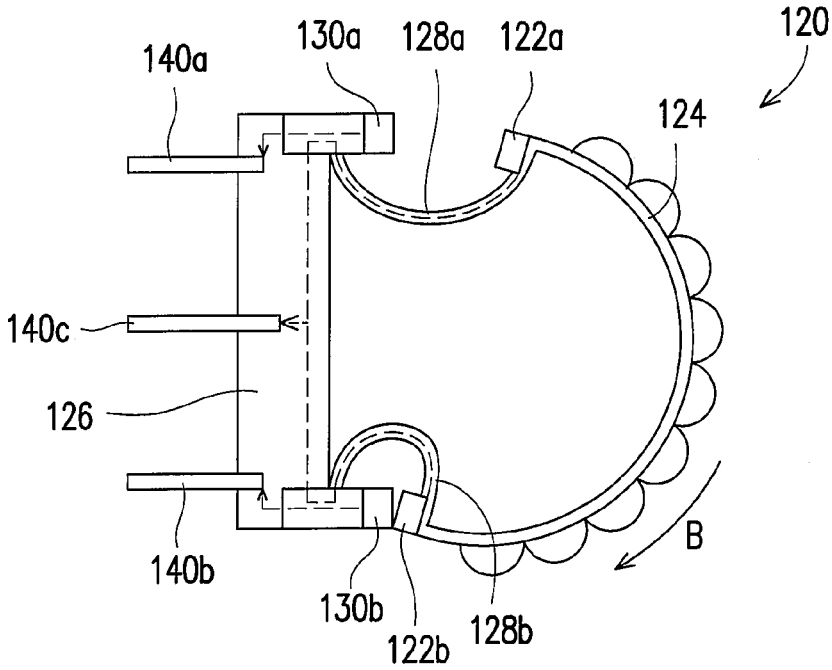
Figure 2C:
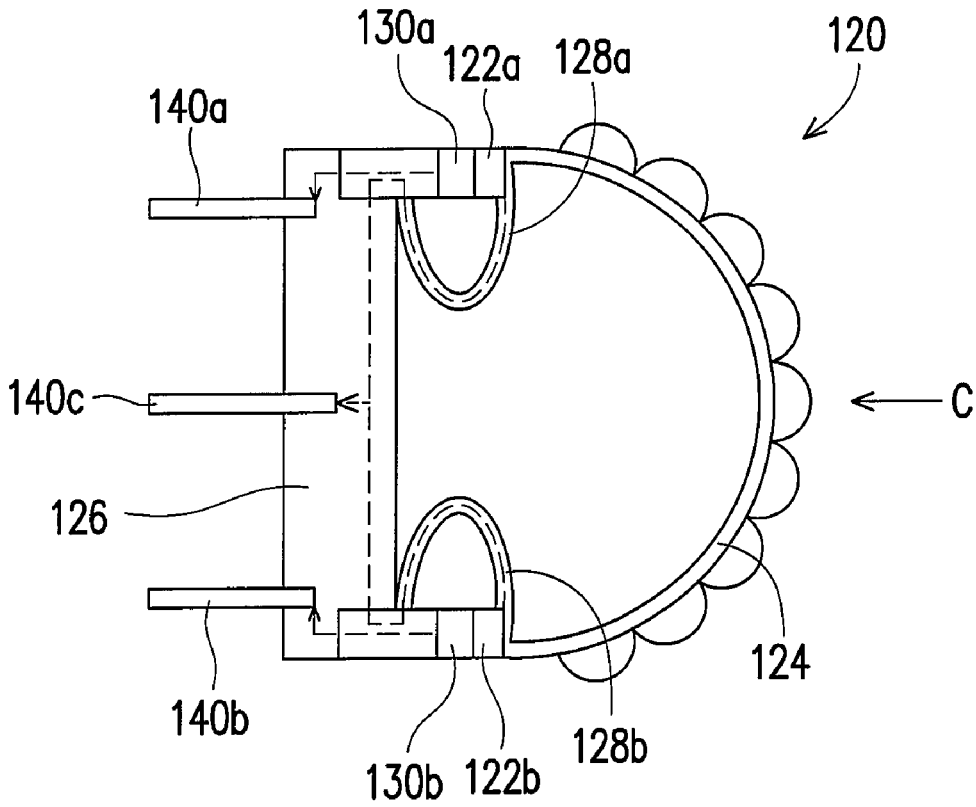

FIGS. 2A to 2C illustrate three operation states respectively of the arcuate elastomer of FIG. 1. Referring to FIGS. 1, and 2A to 2C, when no external force is applied on the arcuate elastomer 120 as shown in FIG. 1, the first movable contact 122*a* does not come in contact with the first fixed contact 130*a*, and the second movable contact 122*b* does not come in contact with the second fixed contact 130*b*.

When an external force A as shown in FIG. 2A is applied on the arcuate portion 124 in a first direction, the first elastic portion 128*a* is deformed so that the first movable contact 122*a* comes in contact with the first fixed contact 130*a*, while the second movable contact 122*b* stay isolated from the second fixed contact 130*b*.

When an external force B as shown in FIG. 2B is applied on the arcuate portion 124 in a second direction, the second elastic portion 128*b* is deformed so that the second movable contact 122*b* comes in contact with the second fixed contact 130*b*, while the first movable contact 122*a* stays isolated from the first fixed contact 130*a*.

When an external force C as shown in FIG. 2C is applied to the arcuate portion 124 in a third direction, the first elastic portion 128*a* and the second elastic portion 128*b* are deformed at the same time so that the first movable contact 122*a* comes in contact with the first fixed contact 130*a*, and the second movable contact 122*b* comes in contact with the second fixed contact 130*b*.

Corresponding to the three different operation states shown in FIGS. 2A to 2C of the arcuate elastomer 120, signals transmitted from the first pin 140*a* and the second pin 140*b* to the processor 110 present three different combinations. In this a way, the processor 110 generates corresponding control signals by evaluating these three signal combinations.

It is to be noted that the present invention does not limit the external force A applied in the first direction shown in FIG. 2A. Any external force which can cause the arcuate elastomer 120 to deform as shown in FIG. 2A is within the scope of the present invention. Likewise, the present invention does not limit the external force B and the external force C as shown in FIGS. 2B and 2C.

In the present embodiment, the signal generating module 100 further includes a signal emitting terminal 150, coupled to the processor 110. The signal emitting terminal 150 is adapted for adjusting a signal emitting intensity according to the foregoing control signals. For example, when the arcuate elastomer 120 is in the operation state as shown in FIG. 2A, the processor 110 generates a first control signal, and when receiving the first control signal, the signal emitting terminal 150 increases the signal emitting intensity. When the arcuate elastomer 120 is in the operation state as shown in FIG. 2B, the processor 110 generates a second control signal, and when receiving the second control signal, the signal emitting terminal 150 decreases the signal emitting intensity. When the arcuate elastomer 120 is in the operation state as shown in FIG. 2C, the processor 110 generates a third control signal, and when receiving the third control signal, the signal emitting terminal 150 sets the signal emitting intensity to be substantially zero.

However, the foregoing corresponding relationships between the operation states of FIGS. 2A to 2B and the signal emitting intensity, i.e., increasing, decreasing, and setting to be substantially zero, are for illustration purpose only and are not intended for limiting the scope of the present invention. In fact, the corresponding relationships can be varied. For example, the operation state of FIG. 2A corresponds to decreasing the signal emitting intensity, the operation state of FIG. 2B corresponds to increasing the signal emitting intensity, and the operation state of FIG. 2C corresponds to setting the signal emitting intensity to be substantially zero.

Because the signal generating module 100 of the embodiment according to the present invention adopts the arcuate elastomer 120, a deformation of the arcuate elastomer 120 can be used for driving the first movable contact 122*a* to come in contact with the first fixed contact 130*a*, and/or driving the second movable contact 122*b* to come in contact with the second fixed contact 130*b*. In this way, the signal generating module 100 can generate signals in accordance with contact status, and adjust the signal emitting intensity with aid of a digital control circuit or software.

In the present embodiment, the signal generating terminal 150 can further include an amplification circuit 152 and a speaker 154, and the signal emitting intensity for example is a sound volume. A user may control the arcuate elastomer 120 to be in operation states illustrated in FIGS. 2A to 2C by applying external forces in different directions to increase, decrease, or mute the sound volume of the speaker 154. However, it is to be noted that in other embodiments according to the present invention, the signal emitting terminal 150 may be a display or other types of signal generating terminals, and the signal emitting intensity for example is brightness of image frames provided by the display or any other kinds of signal emitting intensity.

The signal generating module 100 can adjust the sound volume with an aid of a digital control circuit or software, and therefore the signal generating module 100 can be synchronous with sound volume control software of the electronic apparatus 200, e.g., a notebook computer. That means, when the user adjusting a sound volume by applying an external force on the arcuate elastomer 120, the sound volume setting of the software is adjusted accordingly. In this way, the sound volume adjustment operation can be simplified.

The signal generating module 100 as shown in FIG. 1 can further include a third pin 140*c*, coupled to a grounded terminal of either the processor 110 or the electronic apparatus 200. In the present embodiment, the first pin 140*a* is coupled to the first fixed 130*a*; the second pin 140*b* is coupled to the second fixed contact 130*b*; and the third pin 140*c* is coupled to both the first movable contact 122*a* and the second movable contact 122*b*.

However, in another embodiment (not shown), the aforementioned coupling status between the pins and the contacts can be varied as: the first pin 140*a* is coupled to the first movable contact 122*a*; the second pin 140*b* is coupled to the second movable contact 122*b*; and the third pin 140*c* is coupled to both the first fixed contact 130*a* and the second fixed contact 130*b*.

Furthermore, in still another embodiment (not shown), the aforementioned coupling status between the pins and the contacts can also be varied as: the first pin 140*a* is coupled to the first fixed contact 130*a*; the second pin 140*b* is coupled to the second movable contact 122*b*; and the third pin 140*c* is coupled to both the first movable contact 122*a* and the second fixed contact 130*b*.

It is to be noted that the present invention is not to limit the coupling status as above-described. In other embodiments of the present invention, in accordance with the operation states of the arcuate elastomer 120 shown in FIGS. 2A to 2C, the coupling status of the pins and the contacts can be adapted for obtaining three corresponding combinations from the signals transmitted from the first pin 140*a* and the second pin 140*b* to the processor 110.

Figure 3:
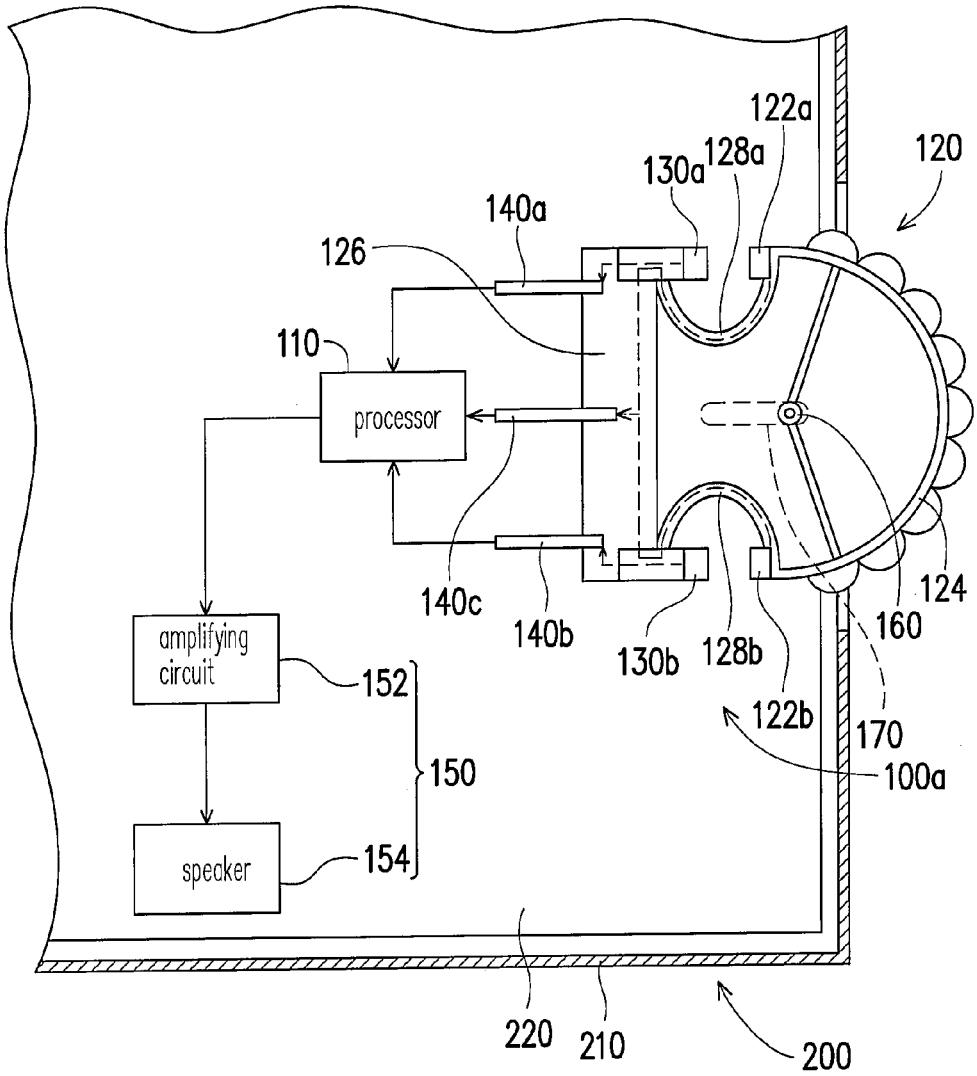
FIG. 3 illustrates a signal generating module employed in an electronic apparatus according to another embodiment of the present invention.

FIG. 3 illustrates a signal generating module employed in an electronic apparatus according to another embodiment of the present invention. Referring to FIG. 3, the signal generating module 100*a* of the embodiment according to the present invention is similar to the signal generating module 100 as shown in FIG. 1, while the only difference is that the signal generating module 100*a* further includes a rotation axis 160. The rotation axis 160 is configured between the arcuate elastomer 120 and the electronic apparatus 200, and can be disposed adjacent to the centre of arcuate portion 124 so that the arcuate portion 124 can rotate around the rotation axis 160, thus the arcuate elastomer 120 can move to different states as shown in FIG. 2A or 2B. Further, the rotation axis 160 is adapted to slide along a rail 170 in the electronic apparatus 200 so as to drive the arcuate elastomer 120 to move to the states as shown in FIG. 2C.

In summary, the signal generating module according to the present invention employs an arcuate elastomer, which can be deformed by applying an external force to have the first movable contact come in contact with the first fixed contact, and/or have the second movable contact come in contact with the second fixed contact. In this way, the signal generating module can generate signals in accordance with contact status, and adjust the signal emitting intensity with an aid of a digital control circuit or software.

Further, the signal generating module according to the present invention can adjust the sound volume with an aid of a digital control circuit or software, and therefore the signal generating module can be synchronous with the sound volume control software of the electronic apparatus, e.g., a notebook computer. That means, when the user adjusts a sound volume by applying an external force on the arcuate elastomer, the sound volume setting of the software is adjusted accordingly. In this way, the sound volume adjustment operation can be simplified.

Furthermore, the arcuate elastomer according to the present invention provides at least three operation states, so that the signal generating module according to the present invention can provide not only functions of increasing and decreasing the sound volume, but also the function of muting the sound volume without adding other buttons or elements.

Moreover, the signal generating module adjusts sound volume without employing a variable resistor, so that there won't be any problem caused by poor contact of variable resistors after long time use.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A signal generating module, adapted for an electronic apparatus having a housing and a circuit board disposed in the housing, the signal generating module comprising:

a processor, disposed on the circuit board;

an arcuate elastomer, disposed in the electronic apparatus, and comprising a first movable contact and a second movable contact, wherein a portion of the arcuate elastomer is exposed out from the housing;

a first fixed contact, fixed to the electronic apparatus, corresponding to the first movable contact;

a second fixed contact, fixed to the electronic apparatus, corresponding to the second movable contact;

a first pin, secured to the circuit board, coupled to the processor, and coupled to one of the first fixed contact and the first movable contact; and a second pin, secured to the circuit board, coupled to the processor, and coupled to one of the second fixed contact and the second movable contact, wherein when no external force is applied on the arcuate elastomer, the first movable contact stays isolated from the first fixed contact, and the second movable contact stays isolated from the second fixed contact either; and when an external force is applied on the arcuate elastomer and the elastomer is deformed, the first movable contact comes in contact with the first fixed contact, and/or the second movable contact comes in contact with the second fixed contact so that the processor generates a control signal by evaluating signals transmitted from the first pin and the second pin.

2. The signal generating module according to claim 1, wherein the arcuate elastomer comprises an arcuate portion, a fixed portion, a first elastic portion and a second elastic portion, the fixed portion is secured to the circuit board, and the first elastic portion and the second elastic portion are connected between the arcuate portion and the fixed portion, when the arcuate portion is subjected to an external force in a first direction, the first elastic portion is deformed thereby, and the first movable contact comes in contact with the first fixed contact while the second movable contact stays isolated from the second fixed contact, and when the arcuate portion is subjected an external force in a second direction, the second elastic portion is deformed thereby, and the second movable contact comes in contact with the second fixed contact while the first movable contact stays isolated from the first fixed contact.

3. The signal generating module according to claim 2, wherein the arcuate portion, the fixed portion, the first elastic portion, and the second elastic portion are integrally formed.

4. The signal generating module according to claim 1, wherein when the arcuate portion is subjected to an external force in a third direction, both the first and the second elastic portion are deformed thereby, and the first elastic portion comes in contact with the first fixed contact, and the second elastic portion comes in contact with the second fixed contact.

5. The signal generating module according to claim 1, further comprising a third pin coupled to a grounded terminal of either the processor or the electronic apparatus.

6. The signal generating module according to claim 5, wherein the first pin is coupled to the first fixed contact, the second pin is coupled to the second fixed contact, and the third pin is coupled to both of the first movable contact and the second movable contact.

7. The signal generating module according to claim 5, wherein the first pin is coupled to the first movable contact, the second pin is coupled to the second movable contact, and the third pin is coupled to both of the first fixed contact and the second fixed contact.

8. The signal generating module according to claim 5, wherein the first pin is coupled to the first fixed contact, the second pin is coupled to the second movable contact, and the third pin is coupled to both of the first movable contact and the second fixed contact.

9. The signal generating module according to claim 1, wherein the signal generating module comprises a signal emitting terminal coupled to the processor and adapted for adjusting an emitting intensity according to the control signal.

10. The signal generating module according to claim 9, wherein the signal emitting terminal comprises an amplification circuit and a speaker.

11. The signal generating module according to claim 9, wherein the signal emitting intensity is a sound volume.

* * * * *